US006112710A

United States Patent [19]

Egan, III et al.

[11] Patent Number: 6,112,710

[45] Date of Patent: Sep. 5, 2000

[54] METHOD AND SYSTEM START-UP APPARATUS FOR REMOVING AIR AND DEBRIS FROM A VALVE ACTUATION SYSTEM

[75] Inventors: James F. Egan, III, West Suffield; Kevin J. Kinerson, Vernon; Joseph M. Vorih, West Suffield, all of Conn.

[73] Assignee: Diesel Engine Retarders, Inc., Wilmington, Del.

[21] Appl. No.: 09/196,239

[22] Filed: Nov. 20, 1998

Related U.S. Application Data

[60] Provisional application No. 60/066,703, Nov. 21, 1997.

[51] Int. Cl.[7] ..... F01L 9/02

[52] U.S. Cl. ..... 123/90.12

[58] Field of Search ..... 123/90.12, 90.57

[56] References Cited

U.S. PATENT DOCUMENTS 4,153,016 5/1979 Hausknecht .
4,231,543 11/1980 Zürner et al. .
4,278,233 7/1981 Zürner et al. .
4,898,128 2/1990 Meneely .
5,152,258 10/1992 D'Alfonso .
5,154,143 10/1992 Stutzenberger .
5,537,976 7/1996 Hu .
5,809,964 9/1998 Meistrick et al. .
5,839,453 11/1998 Hu .
5,857,438 1/1999 Barnard ..... 123/90.12

*Primary Examiner*—Noah P. Kamen
*Attorney, Agent, or Firm*—Collier Shannon Scott, PLLC

[57] ABSTRACT

The present invention is directed to a start-up system for an engine valve actuation assembly. The start-up system may comprise a removal assembly for removing at least one of air and debris from the engine valve actuation assembly during an engine start up operation. The removal assembly may include a supply assembly for supplying fluid to the engine valve actuation assembly under high pressure to remove at least one of air and debris from the engine valve actuation assembly. The supply assembly may include a storage assembly for storing a supply of hydraulic fluid, and a fluid supply assembly for supplying fluid to the storage assembly. The fluid may be supplied under pressure from the storage assembly to the engine valve actuation assembly. Furthermore, the fluid may be supplied under an influence of gravity from the storage assembly to the engine valve actuation assembly.

17 Claims, 3 Drawing Sheets

METHOD AND SYSTEM START-UP APPARATUS FOR REMOVING AIR AND DEBRIS FROM A VALVE ACTUATION SYSTEM

CROSS REFERENCE TO RELATED PATENT APPLICATION

This application relates to and claims priority on Provisional Application Ser. No. 60/066,703, filed Nov. 21, 1997, and entitled "System Start-Up Device."

FIELD OF THE INVENTION

The present invention relates to an engine valve operating system for controlling intake and exhaust events for an internal combustion engine. In particular, the invention is directed to an operating system for filling the valve operating system with hydraulic fluid and removing air from the valve operating system at engine start up and while the system is running. Additionally, the invention relates to the removal of bulk air from a valve actuation system.

BACKGROUND OF THE INVENTION

Conventional valve operating systems consist of combinations of camshafts, push-rods or push-tubes, rocker-arms, and valve-lifters. Camshaft rotation is mechanically slaved to the crankshaft rotation of the engine. Consequently, valve openings, and closings, are fixed to the rotation of a crankshaft. Full authority is defined as having the ability to control the openings, and closings, of an internal combustion engine's intake and exhaust valves independent of the engine's crankshaft rotational position.

The control of exhaust and intake valves of four-cycle internal combustion engines, conventionally, is achieved by mechanical or hydromechanical systems operated synchronously with the engine's crankshaft rotation. The timing of valve openings is fixed in relationship to the crankshaft's position by direct mechanical linking of the valve actuating system with the crankshaft. In any cylinder, of a multi-cylinder internal combustion engine, intake and exhaust valve openings and closings, in conjunction with the fuel mixture and either ignition or fuel injection, are predetermined to provide optimum positive power over a range of engine speeds.

Oil aeration occurs when oil and air are mixed together. Aeration encompasses four distinct forms: air dissolved in oil, entrained air, bulk air, and foam. Bulk air refers to large masses of trapped air, such as air pockets. In a brake housing this situation is created when oil leaks out around pistons and set screws after the engine has sat for a duration of time. Air dissolved in oil assumes a position in the chemical matrix of oil. Entrained air describes pockets of air that are uniformly suspended throughout oil yet are not assimilated into oil like dissolved air. The delineating factor between entrained and bulk air is the size of the voids each creates. Typically, everything 1 mm in diameter and less is defined as entrained air. Hence, bulk air assumes everything larger than 1 mm in diameter. Finally, foam is the occurrence of a separate layer of air bubbles on the surface of a fluid.

Fully hydraulic valve actuation systems are subject to aeration of the oil. Prolonged sedentary states of the engine also promote the accumulation of bulk air in the hydraulic housing due to leak down. Bulk air in the system, especially in the start up mode, may adversely impact the valve motion. In particular, depending on the amount of air entrapped in the system at start-up, the entrapped air may delay or possibly preclude valve opening in response to the hydraulic fluid being pumped through the system. Without the removal of the existing bulk air, the system may become paralyzed or function improperly, which may cause valve opening at non-prescribed timings.

OBJECTS OF THE INVENTION

It is an object of the present invention to provide a hydro-mechanical full authority valve operating system that assures proper operation at cold engine start irrespective of the ambient temperature of the engine at time of start.

It is also an object of the present invention to provide a hydro-mechanical full authority system that assures proper operation at cold engine start irrespective of entrapped air in the system.

It is yet another object of the present invention to provide a hydro-mechanical full authority system that operates effectively across all engine normal operating speeds (RPM range).

It is yet another object of the present invention to provide an assembly and method for removing air in a fully hydraulic valve actuation system during system start-up.

It is another object of the present invention to provide an assembly and method for removing air in a fully hydraulic valve actuation system while the system is operating.

It is another object of the present invention to provide an assembly and method for removing entrained air from a fully hydraulic valve actuation system while the system is operating.

SUMMARY OF THE INVENTION

The present invention comprises a device for the removal of bulk air from a full authority valve operating the system. It also allows for the removal of entrained air once the valve operating system is operational. A small continuous leak provides the system with a way to circulate the oil through the hydraulic circuit, which allows for the removal of particles and cooling of the housing.

The present invention is directed to an improved valve actuation system for actuating at least one valve in an engine during an engine operation. The valve actuation system includes a master piston assembly for supplying actuating energy for actuating the at least one valve, a slave piston assembly for actuating the at least one valve, and a transfer assembly for transferring the actuating energy from the master piston assembly to the slave piston assembly. The improved valve actuation system includes a removal assembly for removing at least one of air and debris from the transfer assembly during an engine start up operation.

The removal assembly may include a supply assembly for supplying fluid to the transfer assembly under high pressure. The supply assembly may include a passageway connected to a high pressure fluid source. The supply assembly may comprise a storage assembly for storing a supply of hydraulic fluid, and a fluid supply assembly for supplying fluid to the storage assembly. The fluid may be supplied under pressure from the storage assembly to the transfer assembly. Furthermore, the fluid may be supplied under the influence of gravity from the storage assembly to the transfer assembly.

The removal assembly may include at least one bleeder assembly for removing at least one of air and debris from the transfer assembly during an engine start up operation. The at least one bleeder assembly may further remove at least one of air and debris from the transfer assembly during a braking operation. The at least one bleeder assembly may be located in a high pressure portion of the transfer assembly. The at least one bleeder assembly is located in a low pressure portion of the transfer assembly. Each of the at least one bleeder assembly may include a valve assembly. The valve assembly may open at a first predetermined pressure to permit the removal of at least one of air and debris. The valve assembly may close at a second predetermined pressure to prevent the removal of at least one of air and debris. The second predetermined pressure is greater than the first predetermined pressure.

The valve actuation system may further include an accumulator assembly for absorbing actuating energy within the transfer assembly during predetermined engine operating conditions.

The present invention is also directed to a start-up system for an engine valve actuation assembly. The start-up system may comprise a removal assembly for removing at least one of air and debris from the engine valve actuation assembly during an engine start up operation.

The removal assembly may include a supply assembly for supplying fluid to the engine valve actuation assembly under high pressure to remove at least one of air and debris from the engine valve actuation assembly. The supply assembly may include a storage assembly for storing a supply of hydraulic fluid, and a fluid supply assembly for supplying fluid to the storage assembly. The fluid may be supplied under pressure from the storage assembly to the engine valve actuation assembly. Furthermore, the fluid may be supplied under an influence of gravity from the storage assembly to the engine valve actuation assembly.

The start-up system may further include a heating assembly for heating hydraulic fluid contained within the start-up system.

The removal assembly may include at least one bleeder assembly for removing at least one of air and debris from the engine valve actuation assembly during an engine start up operation. The at least one bleeder assembly may further remove at least one of air and debris during a braking operation. The at least one bleeder assembly may be a high pressure bleeder assembly.

Each of the at least one bleeder assembly may be a low pressure bleeder assembly. Each of the at least one bleeder assembly includes a valve assembly. The valve assembly may open at a first predetermined pressure to permit the removal of at least one of air and debris. The valve assembly may close at a second predetermined pressure to prevent the removal of at least one of air and debris. The second predetermined pressure is greater than the first predetermined pressure.

The start-up system may further include an accumulator assembly for absorbing actuating energy within the valve actuation assembly during predetermined engine operating conditions.

The present invention is also directed to a method for removing at least one of air and debris from an engine valve actuation assembly during an engine start-up operation. The method includes the step of filling the engine valve actuation assembly with operating fluid under pressure. The method further includes the step of removing at least one of air and debris from the engine valve actuation assembly, wherein the pressurized operating fluid forces the at least one of air and debris from the engine valve actuation assembly. The step of removing at least one of air and debris may include forcing the at least one air and debris through at least one bleeder device located within the engine valve actuation assembly.

The method may further comprise the step of heating the operating fluid during the engine start-up operation. The method may further include the step of absorbing excess operating fluid during the engine start-up operation.

BRIEF DESCRIPTION OF THE DRAWINGS

The present invention will now be described in connection with the following figures in which like reference numbers refer to like elements and wherein.

DETAILED DESCRIPTION OF THE INVENTION

Figure 1:
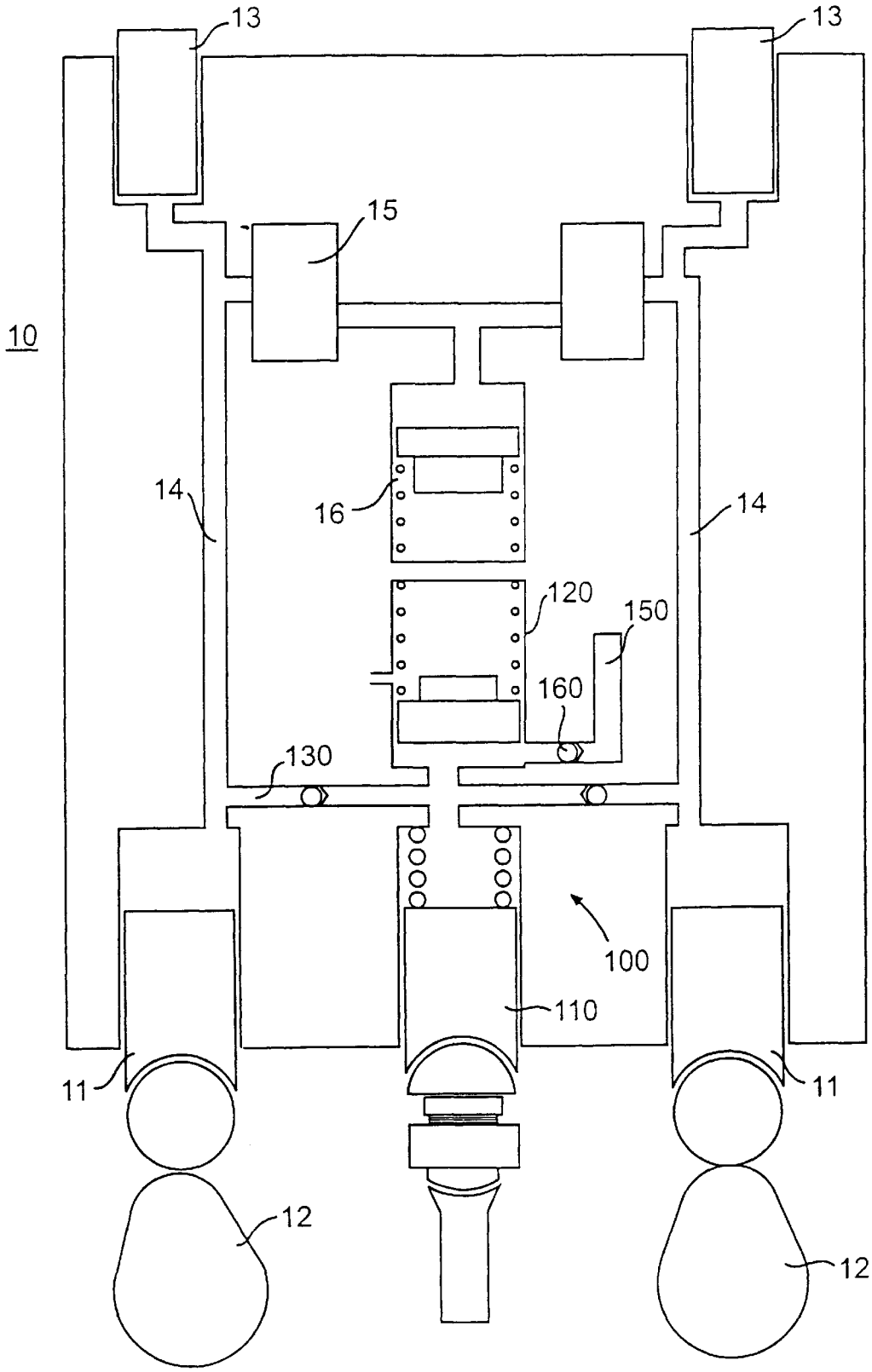
FIG. 1 is a schematic view of a valve control start-up system according to the present invention.

The present invention is directed to a system 100 for filling a valve operating system 10 with hydraulic fluid during engine start up and to remove any air build up within the valve operating system 10. The valve operating system 10 includes a master piston assembly 11 that is operated by a camshaft 12. The master piston assembly 11 hydraulically connected to a slave piston assembly 13 through a hydraulic passageway 14. A valve 15 is provided within passageway 14.

When the valve 15 is closed, motion derived from the master piston assembly 11 is transferred directly to the slave piston assembly 13 to operate an engine valve. When the valve 15 is open, motion from the master piston assembly 11 is transferred to accumulator 16. The accumulator 16 absorbs the motion derived from the master piston assembly 11 such that the slave piston assembly 13 either does not operate the associated valve or the opening of the valve is modified.

During operation of the valve operating system 10, hydraulic fluid may leak out of the system 10. This may also occur when the engine is not running. As a result, air pockets may develop within the hydraulic passageway 14. This may adversely impact the opening of an engine valve in response to movement of the master piston assembly 11, especially in a full authority system. In particular, the motion generated from the master piston assembly 11 may be absorbed in an air pocket; rather than being directly transferred to the slave piston assembly 13. As a result, the slave piston assembly 13 may not properly operate the engine valves when necessary. The present invention prevents this from occurring.

It is contemplated by the inventor of the present invention that the start-up system 100 may be added to existing systems or may be designed into new valve operating systems. As shown in FIG. 1, the system 100 includes a master piston assembly 110. The master piston assembly 110 may derive motion from a push tube or push rod 1 of an injector rocker. It, however, is contemplated that the present invention is not limited to a master piston assembly 110 that derives its motion from a push tube; rather a dedicated cam or any other suitable source of motion may be employed. Furthermore, it is contemplated that the master piston assembly 110 that is electronically operated in response to electronic engine controls rather than push tube be within the scope of the present invention.

The system 100 also includes an accumulator 120. The system 100 is connected to the valve operating system 10 through hydraulic fluid passageway 130. The passageway 130 may contain a check valve 140 positioned therein. The check valve 140 prevents the back flow of hydraulic fluid from the system 10 to the system 100. The accumulator 120 may include a relief port 121 for venting hydraulic fluid to prevent buildup of excess fluid in the accumulator 120. The system 100 may also include a hydraulic fluid supply 150. The supply 150 may include a check valve 160 to prevent the back flow of hydraulic fluid from the system 100 to the supply 140.

The operation of the system 100 will now be described. Prior to the start-up of the engine, the system 10 is not operational. As a result, hydraulic fluid may have drained from the passageway 14 leaving entrapped air, which may result in insufficient fluid pressure within the system 10 to operate effectively. At engine start-up, the push tube 1 supplies energy in the form of motion to the master piston assembly 110. In response to motion of the master piston assembly 110, hydraulic fluid from the fluid source 150 is supplied at high pressure (up to 200 psi, for example) to the valve operating system 10. The input of the high pressure fluid forces any air bubbles trapped within the system 10 to be vented through the slave piston assembly 13 and the master piston assembly 11. As a result, the system 10 is ready for operation without any entrapped air within seconds of engine start-up. An air bleed device 280, as shown in FIG. 2, may also be provided within system 10 and system 100 to permit the venting of air entrapped within systems 10 and 100.

The system 100 may continuously operate during engine operation. In this manner, the system 100 can supply hydraulic fluid to the system 10 to remove any air entrapped within the system 10 that may result from leakage during operation. The accumulator 120 serves to prevent buildup of excessive pressure within the system 100.

Figure 2:
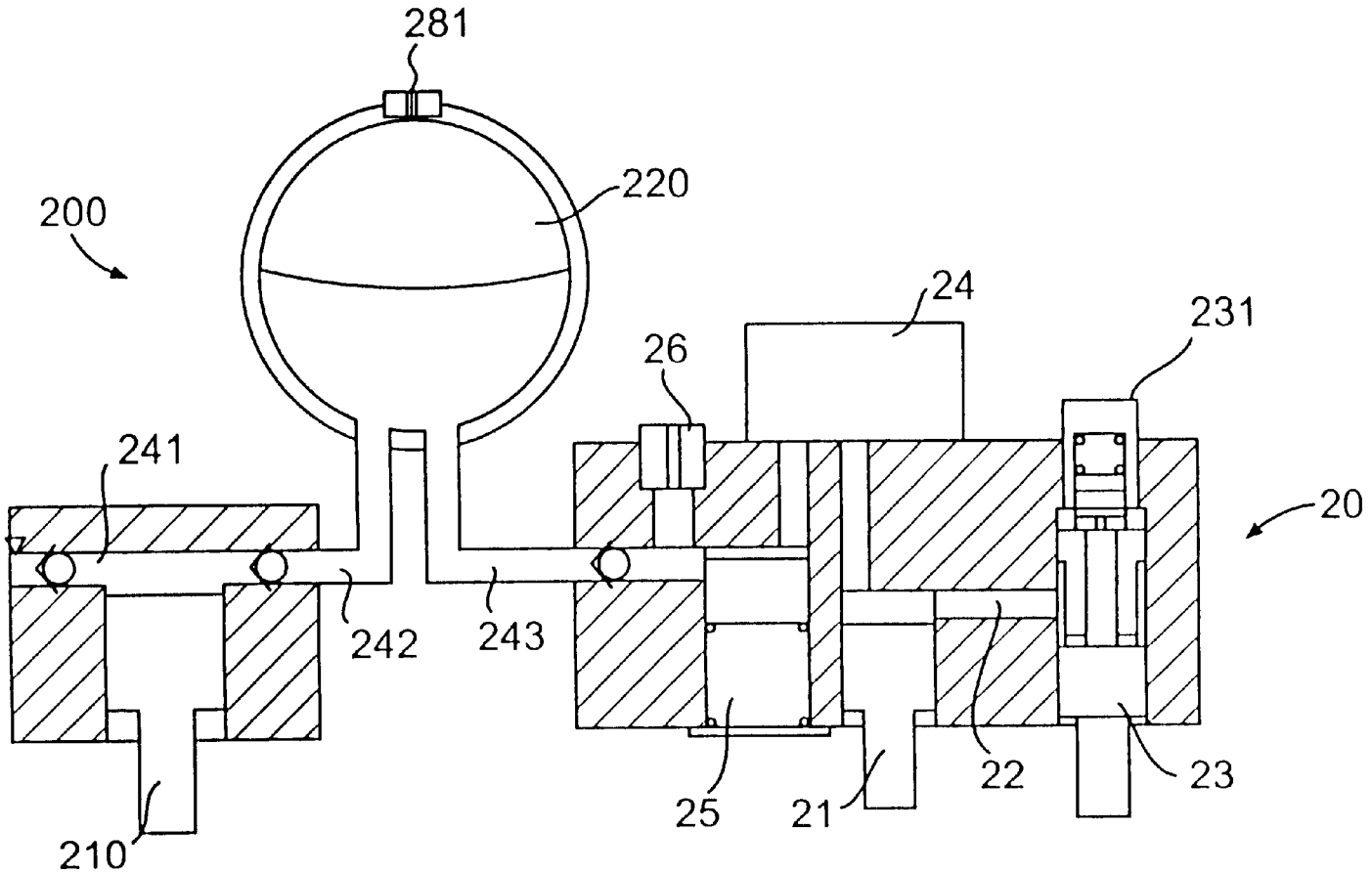
FIG. 2 is a schematic view of a valve control start-up system according to another embodiment of the present invention.

FIG. 2 illustrates another embodiment of the present invention. The start-up system 200 may be connected to a full authority valve actuating system 20. The valve operating system 20 includes a master piston assembly 21. The master piston assembly 21 is operated by a camshaft, a push tube of a rocker arm, or some other suitable source of motion. The master piston assembly 21 supplies motion to a slave piston assembly 23 through a conduit 22. The slave piston assembly 23 operates at least one cylinder valve, not shown. The slave piston assembly 23 may include a valve seating assembly 231 to provide smooth valve seating during operating of the slave piston assembly 23. The system 20 may also include a valve 24. The valve 24 is preferably a high speed trigger valve. An accumulator 25 may be provided.

The start-up system 200 includes a pressure source 210. The pressure source 210 directs hydraulic fluid to a plenum 220. It is contemplated by the inventors of the present invention that the pressure source 210 may be any suitable means for supplying fluid including but not limited to an auxiliary pump (e.g., mechanical pump, electrical pump, and pressure pump), an oil sump, or other oil galley that supplies oil by other means. The plenum 220 may supply hydraulic fluid to more than one valve operating system. A hydraulic fluid source 230 supplies hydraulic fluid to the system 200 from, for example, an engine oil supply through conduit 241. A valve 250 (e.g., a check valve) may be provided within the conduit 241 to prevent the back flow of hydraulic fluid from the pressure source 210 to the plenum 220. The pressure source 210 supplies hydraulic fluid to the plenum 220 through conduit 242 such that a sufficient amount of hydraulic fluid is located within the plenum 220. A valve 260 may be provided between the plenum 220 and the pressure source 210 within the conduit 242 to prevent the back flow of fluid to the pressure source 210 from the plenum 220. The plenum 220 supplies hydraulic fluid to the valve operating system 20 through conduit 243. A valve 270 may be provided between the plenum 220 and the system 20 within the conduit 243 to prevent the back flow of fluid to the plenum 220.

The plenum 220 may be provided with a bleeder device 280. The bleeder device 280 permits air entrapped within the plenum 220 to be vented. Furthermore, the bleeder device 280 will vent hydraulic fluid to vent therethrough in the event of excess pressure build up within the plenum 220. The plenum 220 may also be provided with an accumulator, as shown, for example in FIG. 1, to prevent the buildup of excessive pressure within the plenum 220. Additionally, the system 20 is preferably provided with a bleeder device 26 to permit the venting of entrapped air within the system 20. Furthermore, the bleeder devices described above in connection with FIGS. 5–12 may be incorporated into the system 20.

The plenum 220 may be provided with a heating element to heat the hydraulic fluid within the plenum 220. This heats the hydraulic fluid to improve the viscosity of the fluid during engine start-up.

The operation of the start-up system 200 will now be described. The plenum 220 through the influence of gravity provides a pressurized supply of hydraulic fluid to the system 20. This supply limits the entrapment of air within system 20. Specifically, any air that may be within the system 20 will be forced out through clearances in the slave piston assembly 23 and the master piston assembly 21. Additionally, a bleeder assembly 26 may be provided within the system 20 to permit entrapped air to escape. This embodiment of the present invention relies on force generated by the stored hydraulic fluid rather than relying on the force generated by the push rod, as described above in connection with FIG. 1. With this arrangement, the system 200 is operational even when the engine is off.

Figure 3:
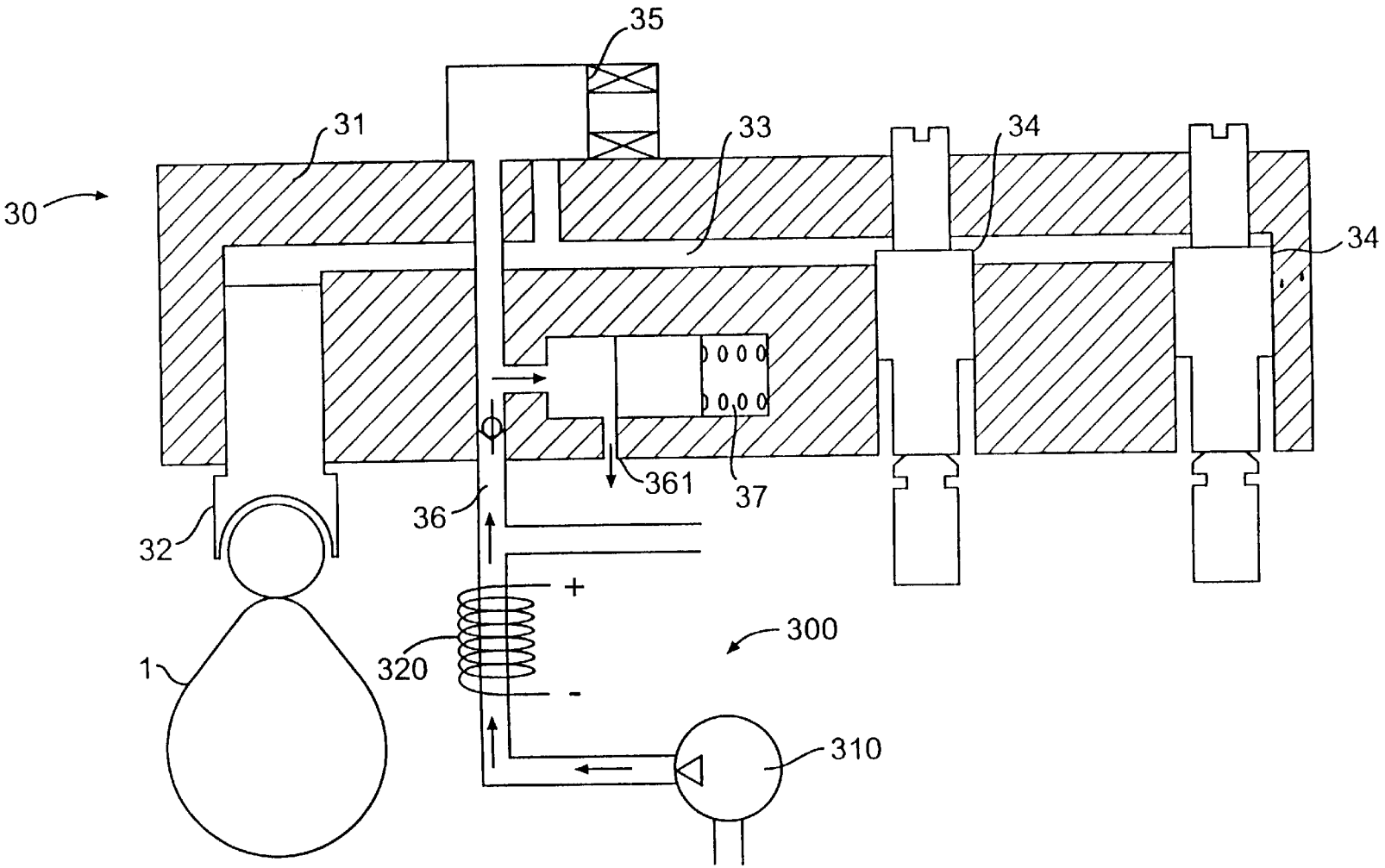
FIG. 3 is a schematic view of a valve control start-up system according to another embodiment of the present invention.

FIG. 3 discloses another embodiment of the start-up system according to the present invention. FIG. 3. depicts the start-up system 300 within a lost motion full authority value actuating system 30. The use of the system 30 is for illustrative purposes only and is not intended to limit the application of the present invention. System 30 includes a housing 31. A master piston assembly 32 may be slidably received within the housing 31. The master piston assembly 32 derives motion from a cam 1. Motion generated by the master piston assembly 32 is transmitted through hydraulic fluid (such as, for example, engine oil) located within a conduit 33 located within housing 31. The housing 31 includes at least one slave piston assembly 34 that is capable of operating at least one valve. The system 30 also includes a valve assembly 35. The valve assembly 35 is connected to a hydraulic fluid supply through conduit 36. Operation of the valve assembly 35 will permit hydraulic fluid to flow into the system 30. An accumulator 37 may be provided in communication with conduit 36 to absorb any build up of hydraulic fluid within the conduit 36 when the valve 35 is closed. The accumulator 37 is provided with a relief port 361 to vent hydraulic fluid in the event of an excessive buildup of pressure within the accumulator 37. In this manner, excess hydraulic fluid may be bled from the system 30 during each operating cycle.

The conduit 36 is connected to the start-up system 300 according to another embodiment of the present invention. The start-up system 300 includes a pumping assembly 310 which is connected to the hydraulic fluid supply. The pumping assembly 310 supplies high pressure fluid to valve assembly 35. When the valve assembly 35 is opened the high pressure fluid forces an air that may be entrapped within the system, 30 to be expelled through the passages surround in the master piston assembly 32 and the slave piston assemblies 34. Additionally, a bleeder device 26, described above, may be provided to vent the system 30.

Furthermore, the system 300 includes a heater assembly 320 to warm the hydraulic fluid within the system 300. The heater assembly 320 is preferably an in-line electric heating element. It, however, is contemplated that other heating elements are capable of being used to warm the hydraulic fluid and are considered to be within the scope of the present invention.

It will be apparent to those skilled in the art that various modifications and variations can be made in the construction and configuration of the present invention without departing from the scope or spirit of the invention. Thus, it is intended that the present invention cover the modifications and variations of the invention. It is contemplated that the present invention is capable of operating during a positive power engine operating condition. It is further contemplated that the present invention is capable operating during other engine operating conditions (i.e., non-positive power). While this invention has been described in conjunction with specific embodiments thereof, it is evident that many alternatives, modifications and variations will be apparent to those skilled in the art. Furthermore, it is contemplated that any slave piston and/or master piston may be used as a tappet system in accordance with the present invention. Accordingly, the preferred embodiment of the invention as set forth herein is intended to be illustrative, and not limiting.

What is claimed is:

1. In a valve actuation system for actuating at least one valve in an engine during an engine operation, said valve actuation system including a master piston assembly for supplying actuating energy for actuating said at least one valve, a slave piston assembly for actuating said at least one valve, and a transfer assembly connected to and extending between said master piston assembly and said slave piston assembly for transferring the actuating energy from said master piston assembly to said slave piston assembly, an improvement comprising:

removal means for discharging at least one of air and debris from said transfer assembly during an engine start up operation, wherein said removal means being connected to said transfer assembly, wherein said removal means includes supply means for supplying fluid to said transfer assembly under high pressure during at least an engine start up operation to discharge at least one of air and debris from said transfer assembly.

2. The valve actuation system according to claim 1, wherein said supply means includes a passageway connected to a high pressure fluid source.

3. The valve actuation system according to claim 1, wherein said supply means comprises:

storage means for storing a supply of hydraulic fluid; and fluid supply means for supplying fluid to said storage means.

4. The valve actuation system according to claim 3, wherein fluid is supplied under pressure from said storage means to said transfer assembly.

5. The valve actuation system according to claim 3, wherein fluid is supplied under an influence of gravity from said storage means to said transfer assembly.

6. The valve actuation system according to claim 1, further comprising an accumulator assembly for absorbing actuating energy within said transfer assembly during predetermined engine operating conditions.

7. The valve actuation system according to claim 1, further comprising heating means for heating hydraulic fluid contained within said valve actuation system.

8. The valve actuation system according to claim 1, wherein said removal means includes at least one bleeder assembly for removing at least one of air and debris from said transfer assembly during an engine start up operation.

9. The valve actuation system according to claim 8, wherein said at least one bleeder assembly further removes at least one of air and debris from said transfer assembly during an engine operation.

10. The valve actuation system according to claim 8, wherein said at least one bleeder assembly is located in a high pressure portion of said transfer assembly.

11. The valve actuation system according to claim 8, wherein said at least one bleeder assembly is located in a low pressure portion of said transfer assembly.

12. The valve actuation system according to claim 8, wherein each of said at least one bleeder assembly includes a valve assembly.

13. The valve actuation system according to claim 12, wherein said valve assembly opens at a first predetermined pressure to permit the removal of at least one of air and debris.

14. The valve actuation system according to claim 13, wherein said valve assembly closes at a second predetermined pressure to prevent the removal of at least one of air and debris.

15. The valve actuation system according to claim 14, wherein said second predetermined pressure is greater than said first predetermined pressure.

16. The valve actuation system according to claim 8, wherein said at least one bleeder assembly is a high pressure bleeder assembly.

17. The valve actuation system according to claim 8, wherein said at least one bleeder assembly is a low pressure bleeder assembly.

* * * * *